US009136610B2

(12) United States Patent
Blalock et al.

(10) Patent No.: US 9,136,610 B2
(45) Date of Patent: Sep. 15, 2015

(54) SATELLITE ANTENNA ADAPTER FOR TRIPOD

(71) Applicant: ViaSat, Inc., Carlsbad, CA (US)

(72) Inventors: Edward Mitchell Blalock, Atlanta, GA (US); Gary M. Miller, Atlanta, GA (US)

(73) Assignee: ViaSat, Inc., Carlsbad, CA (US)

( * ) Notice: Subject to any disclaimer, the term of this patent is extended or adjusted under 35 U.S.C. 154(b) by 320 days.

(21) Appl. No.: 13/834,650

(22) Filed: Mar. 15, 2013

(65) Prior Publication Data

US 2014/0118213 A1 May 1, 2014

Related U.S. Application Data

(60) Provisional application No. 61/720,337, filed on Oct. 30, 2012.

(51) Int. Cl.

| | |
|---|---|
| ***H01Q 1/12*** | (2006.01) |
| ***H01Q 19/10*** | (2006.01) |
| ***H01Q 3/02*** | (2006.01) |

(52) U.S. Cl.

CPC ..... *H01Q 19/10* (2013.01); *H01Q 3/02* (2013.01); *H01Q 19/102* (2013.01); *Y10T 29/49016* (2015.01)

(58) Field of Classification Search

CPC .... H01Q 1/1207; H01Q 1/1235; H01Q 19/10
USPC ..... 343/878, 880, 881, 882
See application file for complete search history.

(56) References Cited

U.S. PATENT DOCUMENTS

| | | | | |
|---|---|---|---|---|
| 4,998,114 | A * | 3/1991 | Eto et al. | 343/840 |
| 5,614,918 | A | 3/1997 | Dinardo et al. | |
| 5,660,366 | A | 8/1997 | Palmer | |
| 7,369,097 | B1 | 5/2008 | Sherwood | |
| 2007/0052607 | A1 * | 3/2007 | Dwornik et al. | 343/766 |

* cited by examiner

*Primary Examiner* — Hoang V Nguyen
(74) *Attorney, Agent, or Firm* — Knobbe Martens Olson & Bear LLP

(57) ABSTRACT

A satellite antenna adapter comprising a bottom plate comprising a top surface and a bottom surface, a reflector mounting plate coupled to the bottom plate. The bottom surface of the bottom plate is constructed to removably couple to a tripod. The top surface of the bottom plate is constructed to removably couple to a satellite antenna feed. The reflector mounting plate is constructed to removably couple to a satellite reflector and is substantially perpendicular to the top surface of the bottom plate.

23 Claims, 7 Drawing Sheets

SATELLITE ANTENNA ADAPTER FOR TRIPOD

CROSS-REFERENCE TO RELATED APPLICATIONS

This application is a nonprovisional application that claims the benefit of and priority to U.S. Provisional Application No. 61/720,337, filed on Oct. 30, 2012, entitled SATELLITE ANTENNA FEED ADAPTER FOR TRIPOD, which is hereby incorporated by reference in its entirety.

TECHNICAL FIELD

The present technology generally relates to satellite antenna mounting systems, and in particular, satellite antenna adapters for mounting a satellite antenna to a tripod or other support device.

DESCRIPTION OF THE RELATED TECHNOLOGY

Satellite News Gathering generally relates to the use of mobile communications equipment for the purpose of worldwide mobile news casting. Satellite News Gathering teams as well as other mobile satellite communication equipment users may include, for example, government users, emergency response and disaster relief teams, tactical military operations, industry personnel, surveying teams, and personal users. Those users may require a portable satellite networking system that can provide fast and cost-effective satellite broadband services. Complete portable satellite antenna packages currently offered to such users may include, for example, satellite reflectors, antenna feeds, electronics packages, and platforms to support the packages.

SUMMARY

The systems, methods and devices described herein have innovative aspects, no single one of which is indispensable or solely responsible for their desirable attributes. Without limiting the scope of the claims, some of the advantageous features will now be summarized.

Embodiments herein generally relate satellite antenna and adapter systems, methods and devices. In some aspects the systems, devices and methods can permit a user to minimize the need for transporting multiple pieces of equipment that have similar functions. For example, the satellite antenna adapters can permit the user of a satellite antenna to utilize a standard camera tripod, for example, with the satellite antenna rather than have to use a dedicated tripod or other support device that only functions with the satellite antenna. In some aspects the systems, devices and methods also are better adapted to accommodate the other components of a satellite antenna system, such as the feed components, wires and other electrical components.

In some aspects, the systems, methods and devices described herein can permit Satellite News Gathering teams and other mobile users transport less equipment to the locations where satellite antenna systems are needed or required. In some cases, Satellite News Gathering teams and other users of such equipment (e.g., military) travel to remote locations with their equipment and wish to carry as little gear as possible, and the systems, devices and methods described herein can facilitate the use of such equipment in remote or non-remote locations. In addition, Satellite News Gathering teams and other mobile users already have and carry camera equipment, including tripod assemblies designed to hold and stabilize cameras. However, those tripods are not configured to support or work with the satellite antennas. Similarly, existing tripods or stands used with satellite antenna equipment are not compatible with camera and video equipment. These Satellite News Gathering teams and other mobile users can benefit from the ability to mount a portable satellite antenna, for example, capable of accessing the internet or transmitting information from a remote location, onto their existing equipment designed to support commercial cameras.

One non-limiting embodiment of the present technology includes a satellite antenna adapter comprising a bottom plate comprising a top surface and a bottom surface, a reflector mounting plate coupled to the bottom plate. The bottom surface of the bottom plate is constructed to removably couple to a tripod and preferably to do so rigidly. The top surface of the bottom plate is constructed to removably couple to a satellite antenna feed. The reflector mounting plate is constructed to removably couple to a satellite reflector and is substantially perpendicular to the top surface of the bottom plate.

Another non-limiting embodiment of the present technology relates to methods of manufacturing the systems, devices and components described herein.

Another non-limiting embodiment of the present technology relates to methods of using of the systems, devices and methods described herein.

Another non-limiting embodiment of the present technology relates to satellite antenna systems that include, for example, a satellite antenna adapter, a satellite reflector, a satellite antenna feed, and a tripod.

Another non-limiting embodiment of the present technology relates to communication equipment adapters, for example, satellite antenna adapters, which may include, for example, a means for removably coupling to a satellite reflector, a means for removably coupling to a satellite antenna feed, and a means for removably coupling to a tripod, wherein said tripod is configured to support a camera.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

The above-mentioned aspects, as well as other features, aspects, and advantages of the present technology will now be described in connection with various embodiments, with reference to the accompanying drawings. The illustrated embodiments, however, are merely examples and are not intended to be limiting. Like reference numbers and designations in the various drawings indicate like elements.

DETAILED DESCRIPTION OF THE PREFERRED EMBODIMENT

Figure 1:
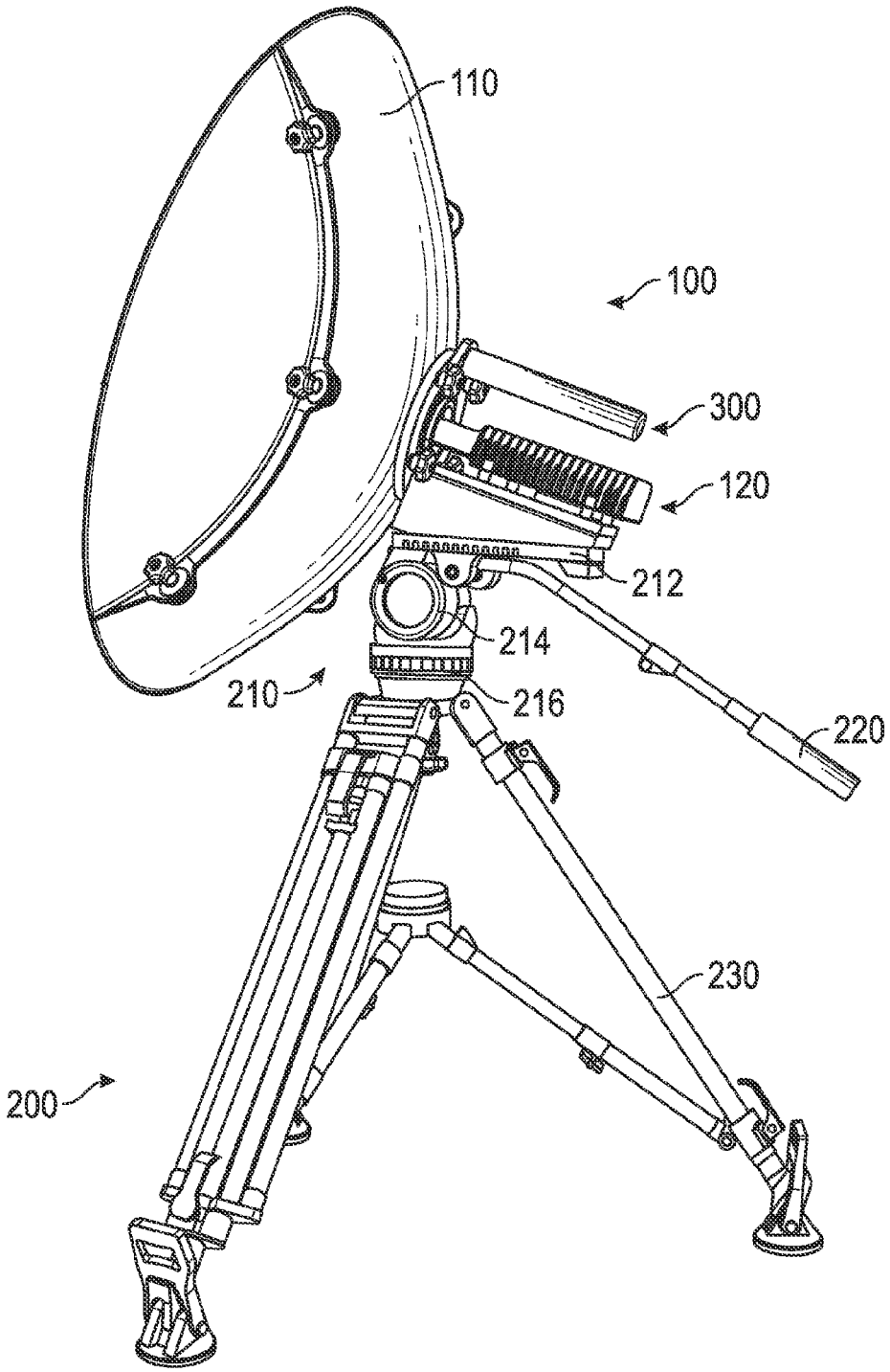
FIG. 1 illustrates a perspective view of a satellite antenna mounted to a satellite antenna adapter which is mounted to a tripod.

In the following detailed description, reference is made to the accompanying drawings, which form a part of the present disclosure. The illustrative embodiments described in the detailed description, drawings, and claims are not meant to be limiting. Other embodiments may be utilized, and other changes may be made, without departing from the spirit or scope of the subject matter presented here. It will be readily understood that the aspects of the present disclosure, as generally described herein, and illustrated in the Figures, can be arranged, substituted, combined, and designed in a wide variety of different configurations, all of which are explicitly contemplated and form part of this disclosure. For example, a system or device may be implemented or a method may be practiced using any number of the aspects set forth herein. In addition, such a system or device may be implemented or such a method may be practiced using other structure, functionality, or structure and functionality in addition to or other than one or more of the aspects set forth herein. Alterations and further modifications of the inventive features illustrated herein, and additional applications of the principles of the inventions as illustrated herein, which would occur to one skilled in the relevant art and having possession of this disclosure, are to be considered within the scope of the invention.

Embodiments described herein generally relate to systems, devices and methods related to satellite antenna adapters. More specifically, some embodiments relate to adapters that can be used to permit satellite antenna equipment to be used with a non-dedicated tripod, mount or stand, that is, with a tripod that can be used with other types of equipment instead of only with the antenna equipment. For example, rather than being required to have a dedicated tripod or stand that only works with the satellite antenna equipment, the adapters can permit satellite antenna equipment to be used with a video camera tripod, a surveyor's tripod, or the like. This can permit the user of the satellite antenna equipment to avoid having to transport, carry and/or store multiple tripods for different types of equipment. In some aspects, the adapter devices also can be configured to work with satellite antenna pointing aids, for example, devices that facilitate proper positioning or directing of the satellite antenna.

Some embodiments relate to satellite antenna adapters. The adapters can permit satellite antenna equipment to be mounted on or secured to a tripod that also can be used for other equipment. For example, the tripod can be a multi-use or a non-dedicated tripod that can be used with a camera, surveying equipment, a telescope or other equipment that is mounted on or attached to a tripod.

The antenna satellite antenna adapters can include, for example, a bottom plate that includes a top surface and a bottom surface; and a reflector mounting plate coupled to the bottom plate. The bottom surface of the bottom plate can be configured to couple to a tripod, preferably to removably couple to a tripod. The top surface of the bottom plate may be configured to couple (preferably removably) to a satellite antenna feed. The reflector mounting plate can be configured to couple (preferably removably) to a satellite reflector. The reflector mounting plate can be configured on the adapter to be substantially perpendicular to the top surface of said bottom plate. The bottom surface of the satellite antenna adapter further can include a mounting portion located on its bottom surface. The mounting portion may be configured to removably couple directly to a tripod, for example. The mounting portion can be configured to couple to a tripod plate, for example a camera tripod plate that is normally used to attach to a camera that is to be used with a given tripod. The mounting portion can include at least one mounting hole configured to accept a tripod plate fastener. The top surface of the bottom plate can be inclined relative to the bottom surface of the bottom plate, for example, such that the greatest distance between the top surface and the bottom surface is closest to or adjacent to the reflector mounting plate. That incline or angle can permit the satellite antenna to point or angle more or less upwards towards the sky and a desired satellite position, even when the tripod is on more or less flat ground. The reflector mounting plate comprises an aperture formed therethrough, wherein said aperture is configured to allow at least a portion of said antenna feed to pass through said aperture.

The reflector mounting plate of the satellite antenna adapter can include at least one reflector mounting hole formed therethrough, which can be configured to accept a reflector fastener, for example, that is configured to couple (preferably removably) the reflector mounting plate to the satellite reflector. The satellite antenna adapter further can include at least one mounting peg, for example, that protrudes from the top surface of the bottom plate. The mounting peg can be configured to removably couple the satellite antenna feed to the satellite antenna adapter. The mounting peg can be of any suitable shape or design, for example, cylindrical in shape. The mounting peg can include a lower portion and an upper portion and the lower portion can include or have a smaller diameter than said upper portion, if desired. The satellite antenna adapter of claim further may include an adapter handle. The handle can protrude, attach to or extend from any desired portion of the adapter, but preferably is attached to reflector mounting plate. The antenna adapter further can include an electronic pointing aid mount. The electronic pointing aid mount may include, for example, a recess configured to accept or hold an electronic pointing aid. The electronic pointing aid be or include, any suitable device, such as for example, a mobile phone, smartphone, a handheld computing device (e.g., an iPod, an iPad, other tablet devices, or other mini or handheld computing devices), or the like.

Some embodiments relate to satellite antenna systems that include a satellite antenna adapter as set forth herein. The satellite antenna systems can include, for example, one or more of satellite reflector; a satellite antenna feed, and a tripod. The said tripod can be, for example, a camera tripod, a telescope tripod, a surveyor's tripod, or any other tripod that is configured for use with other equipment, particularly non satellite antenna equipment.

Some embodiments relate to satellite antenna adapter that include one or more of means for coupling the antenna adapter to a satellite reflector; means for coupling the antenna adapter to a satellite antenna feed; and means for removably coupling the antenna adapter to a tripod, wherein the tripod is a tripod, a telescope tripod, a surveyor's tripod, or any other tripod that is configured for use with other equipment, particularly non satellite antenna equipment camera tripod or a surveying equipment tripod. The tripod can be a multi-use tripod. One or more of the various couplings can be removable, for example. The couplings can be removable in the sense that the adapter can be unattached or uncoupled from one or more of the tripod, the satellite antenna, the satellite antenna reflector, or the antenna feed and electronics. The means for coupling to a tripod can include means for coupling to a tripod plate, for example a camera tripod plate.

Some embodiments relate to methods of securing a satellite antenna to a tripod that typically has use with other non-satellite antenna equipment, for example, a camera tripod, a telescope tripod, a surveyor's tripod, or any other tripod that is configured for use with other equipment. The methods can include providing an adapter as described herein. The methods can permit the use of various tripods with the adapters so that the tripods can be used to mount satellite antenna systems.

The Figures now will be described. The various features of the Figures are illustrative only and are not meant to limiting. Many of the depicted components can be excluded in some aspects, if desired.

FIG. 1 illustrates a perspective view of a satellite antenna 100 mounted to a satellite antenna adapter 300, which is mounted to a tripod 200. A satellite antenna 100 as depicted includes a satellite reflector 110, and an antenna feed 120 that includes an electronics package. The satellite reflector 110 may have, for example, a curved surface with the cross sectional shape of a parabola to direct the signal between a satellite and the tip portion of the antenna feed 120 at the focus point of the satellite reflector 110. Some satellite reflectors 110, especially those intended for portable applications, may include or consist of multiple pieces, which can be fastened together, for example, in the field. Further details of the antenna feed 120 are discussed below in connection with FIG. 4.

FIG. 1 depicts a tripod 200. The tripod 200 as depicted includes a three legged frame constructed to support and maintain the stability of another object. Tripods can be portable in the sense that they can be, for example, transported, deployed, adjustable, and/or dismantled. In the Satellite News Gathering field, tripods are often constructed to support a camera. The camera may be a still camera or video camera. The depicted tripod 200 includes a set of tripod legs 230, a tripod head 210, and at least one tripod handle 220. Tripod legs 230 generally can be pivotally coupled at their upper end to a tripod head 210 so that the legs can be pivoted back to a more or less parallel position with respect to each other. The ability to make the tripod compact when not in use can allow for easier storage and transport of the tripod 200. Each tripod leg 230 may rotate from a substantially parallel position in a collapsed state to a deployed state where each tripod leg 230 is angled outwards at angle of approximately 5 to 75 degrees from vertical or from a central axis. The tripod legs 230 also may be adjustable in length to alter the height of the tripod head 210 and thus the height of the object which the tripod 200 is supporting. The adjustable length of the legs 230 also allows the size of the tripod 200 to be further minimized in a collapsed state for storage and transport. When the tripod 200 is deployed, as illustrated in FIG. 1, the bases of the legs 230 are spread out providing stability to the tripod 200 and the objects which it is supporting.

The tripod head 210 may include a tripod base 216, an intermediate portion 214, a receiver 212, and a tripod handle 220. The tripod base 216 may be constructed to pivotally couple to the tripod legs 230. The bottom portion of the receiver 212 can be pivotally coupled to the tripod base 216 via the intermediate portion 214. The receiver 212 may be pivotally coupled to the tripod base 216 along more than one axis. The tripod head 210 also may include a tripod handle 220 affixed to the receiver 212 or a portion of the intermediate portion 214, allowing a user to more easily manipulate the angle of the receiver 212, and the objects the tripod 200 is supporting, relative to the tripod base 216. The intermediate portion 214 may use a variety of pivoting devices, components or means, which may include, for example, axles, U-joints, or ball joints. The tripod head 210 may allow for independent rotation of the camera about each axis of rotation or each axis of rotation may be coupled to other axis of rotation. The tripod head 210 may include a locking mechanism or means to lock the rotation of the receiver 212 relative to the base. The tripod head 210 may include a separate locking mechanism for each axis of rotation or the tripod head 210 may lock all axis of rotation at once.

For the particular tripod depicted in FIG. 1, the top portion of the receiver 212 is constructed to couple to a camera, which of course is not shown since the instant technology allows it to be used with a satellite antenna (other tripods can include receivers configured to couple to other types of equipment). The receiver 212 may be constructed (as necessary for typical use) to couple directly to a camera. The receiver 212 may incorporate a threaded fastener that when used with a camera, permits attachment of the camera to the receiver 212 via the threaded hole and fastener. A camera typically includes an internally threaded hole constructed to accept a threaded fastener (e.g., a screw or bolt). The receiver 212 also can be configured to couple directly to an object (such as a camera or in this case a satellite antenna adapter system) by other means, a quick release for example. Further details of release (including quick release mechanisms) are discussed below.

In one embodiment, as illustrated in FIG. 1, the satellite antenna adapter 300 is constructed to support a satellite antenna 100 while mounted on a tripod 200. In one embodiment, the satellite antenna adapter 300 is constructed to removably couple a satellite reflector 110 and an antenna feed 120 with integrated electronics to a tripod 200. In one embodiment the satellite antenna adapter 300 is constructed so that the satellite reflector 110 is substantially perpendicular to the top surface 410 of the bottom plate 400 of the adapter 300 and the antenna feed 120 is substantially parallel to the top surface 410 of the bottom plate 400 of the adapter 300. In one embodiment the satellite antenna adapter 300 is constructed to account for the difference between the angle at which a camera is normally inclined relative to the ground when mounted to a tripod 200 and the angle of inclination which a satellite antenna 100 may require. The satellite antenna adapter 300 may be constructed to incline the satellite antenna feed 120 relative to the top surface 218 of the receiver 212 of a tripod 200, even when the tripod 200 is not in an inclined position.

Figure 2:
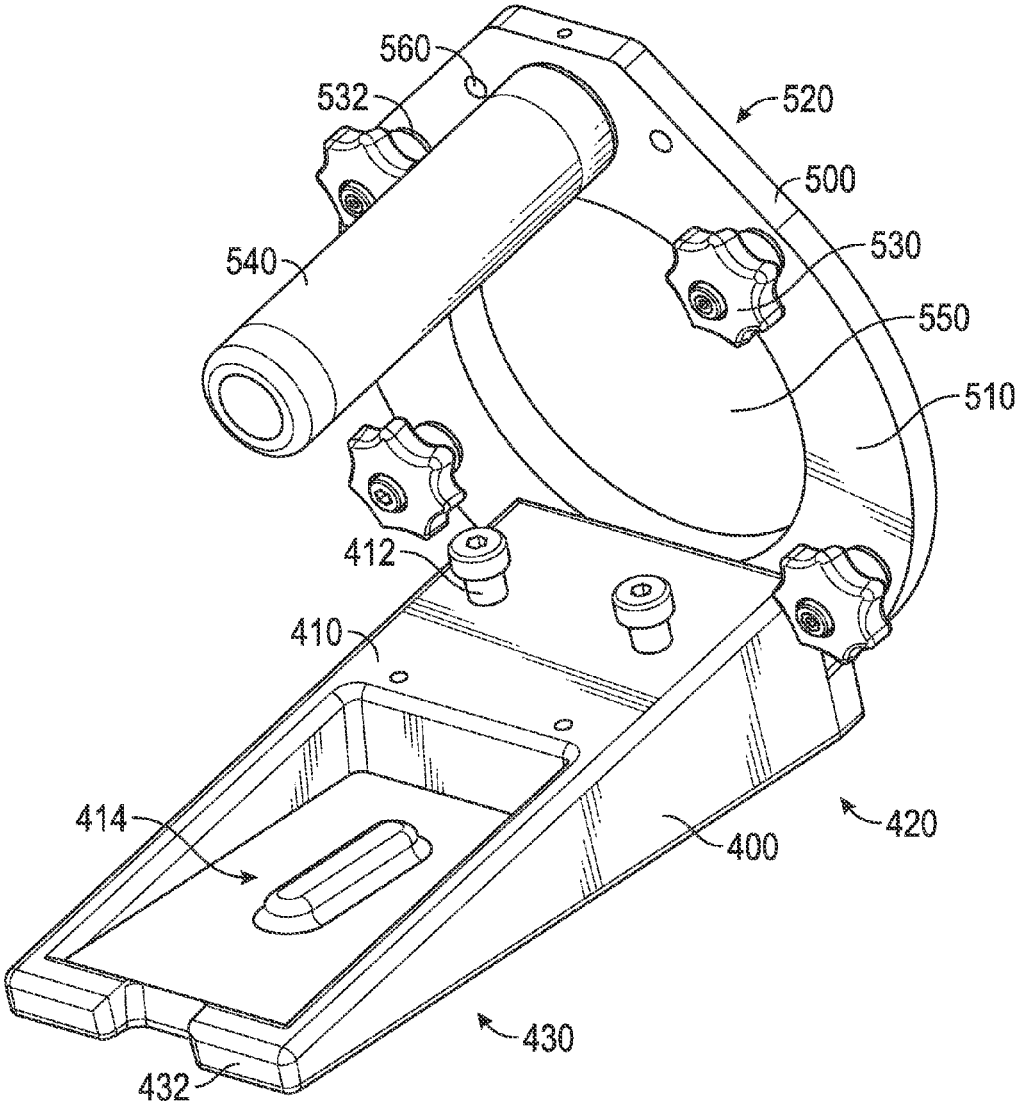
FIG. 2 illustrates a top perspective view of a satellite antenna adapter.

FIG. 2 illustrates a top perspective view of a satellite antenna adapter 300. In one embodiment, the satellite antenna adapter 300 includes a bottom plate 400 and a reflector mounting plate 500. The bottom plate 400 includes a top surface 410 and a bottom surface 440 (See FIG. 3A) opposite the top surface 410. In one embodiment the bottom surface 440 is constructed to removably couple to a tripod 200. In one embodiment, the top surface 410 is constructed to removably couple to a satellite antenna feed 120.

In one embodiment the satellite antenna adapter 300 includes a forward portion 420 and a rear portion 430 where the forward portion 420 is located closer to the satellite reflector 110 and the rear portion 430 is located further from the satellite reflector 110. In one embodiment, the top surface 410 is inclined relative to the bottom surface 440 so that the antenna feed 120 is angled relative to the top surface 218 of the receiver 212 of the tripod 200. As depicted, the top surface 410 is angled upwards toward forward portion 420 of the bottom plate 400 such that the bottom plate 400 is effectively thicker towards the forward portion 420 and thinner towards the rear portion 430. Put another way, the top surface 410 is the furthest from the bottom surface 440 adjacent the reflector mounting plate 500. In some embodiments the top surface 410 may be angled relative to the bottom surface 440 approximately 3 to 45 degrees, approximately 5 to 15 degrees, or approximately 10 degrees, for example. It should be understood that in some embodiments, the top surface 410 of the satellite antenna adapter 300 may be substantially parallel to the bottom surface 440 or angled so that the rear is higher or thicker than the front portion.

In one embodiment the bottom plate 400 may incorporate weight saving features. In one embodiment, as illustrated in FIG. 2, the top surface 410 of the bottom plate 400 may incorporate a first recess 414. The recess 414 regardless of saving weight, also can provide a surface that is parallel to the bottom surface 440, which can facilitate attaching the adapter to the tripod, for example. In other embodiments the bottom plate 400 may incorporate other recesses or multiple recesses to minimize the weight of or provide other functionality to the satellite antenna adapter 300.

In one embodiment the bottom plate 400 may include means for restraining the satellite antenna feed 120 to the bottom plate 400. In one embodiment, the bottom plate 400 may incorporate at least one mounting peg 412 constructed to couple the satellite antenna feed 120 to the satellite antenna adapter 300. In one embodiment, the mounting peg 412 includes a cylindrical protrusion from the top surface 410 of the bottom plate 400. In one embodiment, each mounting peg 412 includes a lower portion and an upper portion where the lower portion comprises a smaller diameter than the upper portion. In one embodiment each mounting peg 412 is rigidly coupled to the bottom plate 400. In one embodiment each mounting peg 412 is permanently mounted to the bottom plate 400, for example each peg may be welded to the bottom plate 400 or may be secured using an adhesive. In one embodiment the bottom plate 400 has at least one hole or opening formed there through to accept each mounting peg 412. In one embodiment each mounting peg 412 may incorporate a threaded portion. In one embodiment each hole may incorporate internal threads to accept the threaded portion of each mounting peg 412. In one embodiment, the threaded portion of each mounting peg 412 may pass through a portion of the bottom plate 400 and a nut may be used to secure the mounting peg 412 to the bottom plate 400.

In one embodiment the bottom plate 400 includes a rear surface 432 and a forward surface (hidden from view) opposite the rear surface 432. In one embodiment the forward surface or face of the bottom plate 400 is substantially perpendicular to the top surface 410 of the bottom plate 400. In one embodiment, the reflector mounting plate 500 includes a plate mounting surface 510 and a reflector mounting surface 520 opposite said plate mounting surface 510 (hidden from view). In one embodiment the plate mounting surface 510 is substantially parallel to the reflector mounting surface 520. In one embodiment, the reflector mounting plate 500 is rigidly coupled to the bottom plate 400. In one embodiment the reflector mounting plate 500 may be attached (e.g., bolted) to the above-described, substantially perpendicular, forward surface or face of bottom plate 400 as illustrated in FIG. 3A.

Figure 3A:
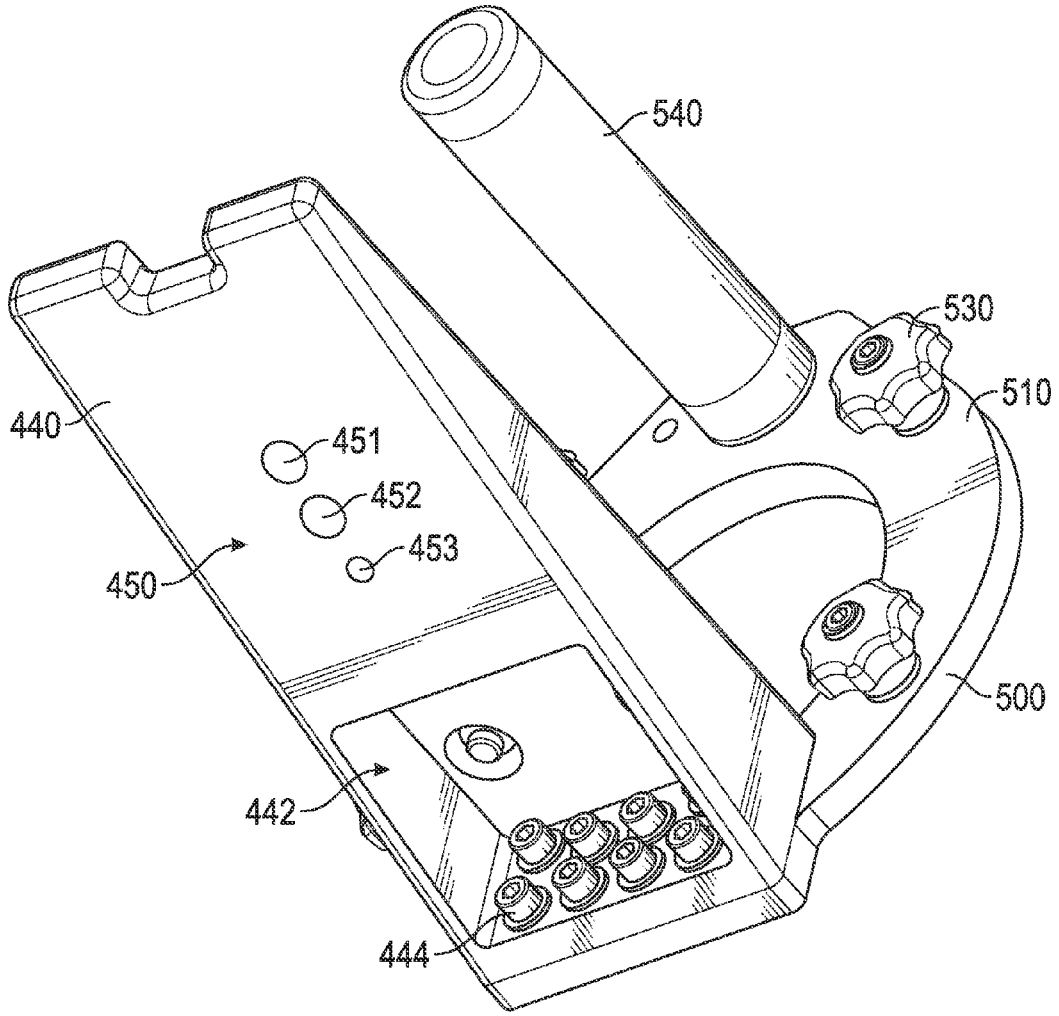
FIG. 3A illustrates a bottom perspective view of a satellite antenna adapter.

Referring still to FIG. 3A, in some embodiments, the reflector mounting plate 500 and a portion of the bottom plate 400 may include, for example, one or more holes formed there through constructed to accept one or more mounting plate fasteners 444 that couple the reflector mounting plate 500 to the bottom plate 400. In one embodiment, the holes formed in the reflector mounting plate 500 can be internally threaded to accept a fastener which passes through a portion of the bottom plate 400. In one embodiment, the bottom plate 400 may incorporate a second recess 442 in the bottom surface 440 constructed to provide access for at least one mounting plate fastener 444. In other embodiments the reflector mounting plate 500 may be rigidly coupled to the bottom plate 400 using an alternative method which may include, for example, welding, adhesives, rivets, clamping mechanisms, mechanical fastening, etc. In one embodiment the plate mounting surface 510 of the reflector mounting plate 500 abuts the forward surface of the bottom plate 400. In one embodiment the reflector mounting plate 500 is substantially parallel to the forward surface of the bottom plate 400. In on embodiment the reflector mounting plate 500 is substantially perpendicular to the top surface 410 of the bottom plate 400 to ensure that the antenna feed 120, when mounted to the top surface 410 of the bottom plate 400, is perpendicular to the reflector, when mounted to the reflector mounting plate 500, ensuring the tip of the antenna feed 120 is located at the focal point of the satellite reflector 110.

In one embodiment, as illustrated in FIG. 1, the reflector mounting plate 500 is constructed to removably couple to a satellite reflector 110. In one embodiment, the satellite adapter is constructed to quickly couple or uncouple from the satellite reflector 110 so that the assembly can be deployed quickly in the field. Referring to FIG. 2, in one embodiment, the reflector mounting surface 520 is constructed to abut the satellite reflector. In one depicted embodiment, the reflector mounting plate 500 includes at least one reflector mounting hole 532 formed through the reflector mounting plate 500 to allow a reflector fastener 530 to pass through and couple to the satellite reflector when attached (e.g., reflector 110 shown in FIG. 1). In one embodiment, each reflector fastener 530 includes a threaded portion and an engaging portion. In one embodiment, the engaging portion is constructed to allow the reflector fastener 530 to be installed quickly and easily by hand. In one embodiment, the engaging portion may incorporate several protrusions perpendicular to the axis of the reflector fastener 530 constructed to be easily manipulated by hand. In one embodiment, each reflector fastener 530 is constructed to be retained by reflector mounting plate 500 so each reflector fastener 530 is not lost after decoupling the satellite reflector 110 form the satellite adapter. In one embodiment the satellite reflector includes or incorporates at least one hole to accept each reflector fastener 530. In one embodiment, those holes may be internally threaded to accept the threaded portion of each reflector fastener 530. In other embodiments, the reflector mounting plate 500 may couple to the satellite reflector 110 using alternative attachment mechanisms or means, for example, the coupling may be achieved with camlock fasteners, clips, magnets, etc. In one embodiment the satellite reflector and/or reflector mounting plate 500 may incorporate protrusions which interact with holes formed in the other and be locked in place via a locking mechanism or clip system. In on embodiment, the reflector mounting plate 500 may be substantially circular in shape. In one embodiment the bottom of the reflector mounting plate 500 may incorporate a shape which substantially complements the portion of the bottom plate 400 to which the reflector mounting plate 500 is mounted.

In one embodiment the satellite antenna adapter 300 includes an adapter handle 540, for example, so that a user can easily carry, move and/or maneuver the satellite adapter as well as any objects which may be coupled to the satellite antenna adapter 300. In one embodiment, the reflector mounting plate 500 includes an adapter handle 540. In one embodiment the adapter handle 540 may be mounted directly to the reflector mounting plate 500. In one embodiment the reflector mounting plate 500 may incorporate a hole formed therein to accept the adapter handle 540. In one embodiment the adapter handle 540 may be retained by an interference fit between the adapter handle 540 and the hole formed therein the reflector mounting plate 500. In another embodiment the adapter handle 540 may be coupled to the reflector mounting plate 500 with an adhesive or by welding the adapter handle 540 the reflector mounting plate 500. In another embodiment, the adapter handle 540 may incorporate a threaded portion and the hole formed therein the reflector mounting plate 500 may incorporate internal threads constructed to accept the threaded portion of the adapter handle 540. In one embodiment the adapter handle 540 may be mounted to the electronic pointing aid mount 600 described below. In one embodiment the adapter handle 540 may be mounted to another portion of the satellite antenna adapter 300 which may include, for example, the bottom plate 400.

A satellite reflector 110 may incorporate an aperture 550 formed there through, for example, to allow an antenna feed 120 to pass there through. A satellite reflector 110 may also incorporate an annular ring-like protrusion surrounding the aperture 550. In one embodiment, the reflector mounting plate 500 incorporates an aperture 550 formed through the plane of the plate mounting surface 510 and reflector mounting surface 520 constructed to allow an antenna feed 120 to pass therethrough. In one embodiment, the aperture 550 in the reflector mounting plate 500 is substantially circular in shape. Although the depicted aperture 550 is shown as a continuous circular opening completely encompassed, it should be appreciated that it could include a break or opening, for example such that it would appear to form a letter "c" or a "u" for example. In one embodiment, the aperture 550 is constructed to complement an annular protrusion of a satellite reflector 110 so that the inside surface of the reflector mounting plate 500 produced by the aperture 550 contacts the outside surface of the annular protrusion of a satellite reflector 110.

FIG. 3A illustrates a bottom perspective view of a satellite antenna adapter 300. In one embodiment, the satellite antenna adapter 300 is constructed to couple to a tripod 200, preferably in a rigid manner. In one embodiment, the bottom surface 440 of the bottom plate 400 is constructed to couple to the top surface 218 of the receiver 212 of a tripod 200. In one embodiment, the bottom plate 400 incorporates a mounting portion 450 that can removably couple to or contact the top face or surface 218 of the receiver 212 of a tripod 200. In one embodiment, the bottom plate 400 incorporates a mounting portion 450 that couples to a camera tripod plate 240 (see FIG. 3B). In one embodiment, the satellite antenna adapter 300 is constructed to quickly and easily couple and uncouple to a tripod plate 240 so that the user can change tripod plates 240 quickly and easily allowing different tripods 200 systems to work with the satellite antenna adapter 300. Some embodiments relate to kits that can include an adapter 300 and/or a variety of the tripod plates 240 for different tripods. In one embodiment, the mounting portion 450 includes at least one mounting hole formed therein said bottom plate 400 and passing through the bottom surface 440 of the bottom plate 400. In one embodiment, each mounting hole is constructed to accept a fastener including a threaded portion. In one embodiment, each mounting hole includes an internal thread formed therein said bottom plate 400. In one embodiment, each mounting hole may incorporate the same size thread as another mounting hole. In one embodiment, each mounting hole may be of a different size and/or incorporate a different size thread in order to couple to different kinds of tripods 200 and/or tripod plates 240. In one embodiment, the satellite antenna adapter 300 is constructed to couple to a Sachtler™ Touch and Go Plate. In one embodiment, the mounting portion 450 includes three mounting holes 451, 452, 453. In one embodiment, the first mounting hole 451 may be drilled and tapped for a ⅜-16 thread or threaded insert. The second mounting hole 452 may be drilled and tapped for a ⅜-16 thread or threaded insert. The third mounting hole 453 may be drilled and tapped for a ¼-20 thread or threaded insert. In other embodiment, additional mounting hole sizes and threads are possible. In one embodiment, the number and location of the mounting holes 451, 452, 453 may differ.

Figure 3B:
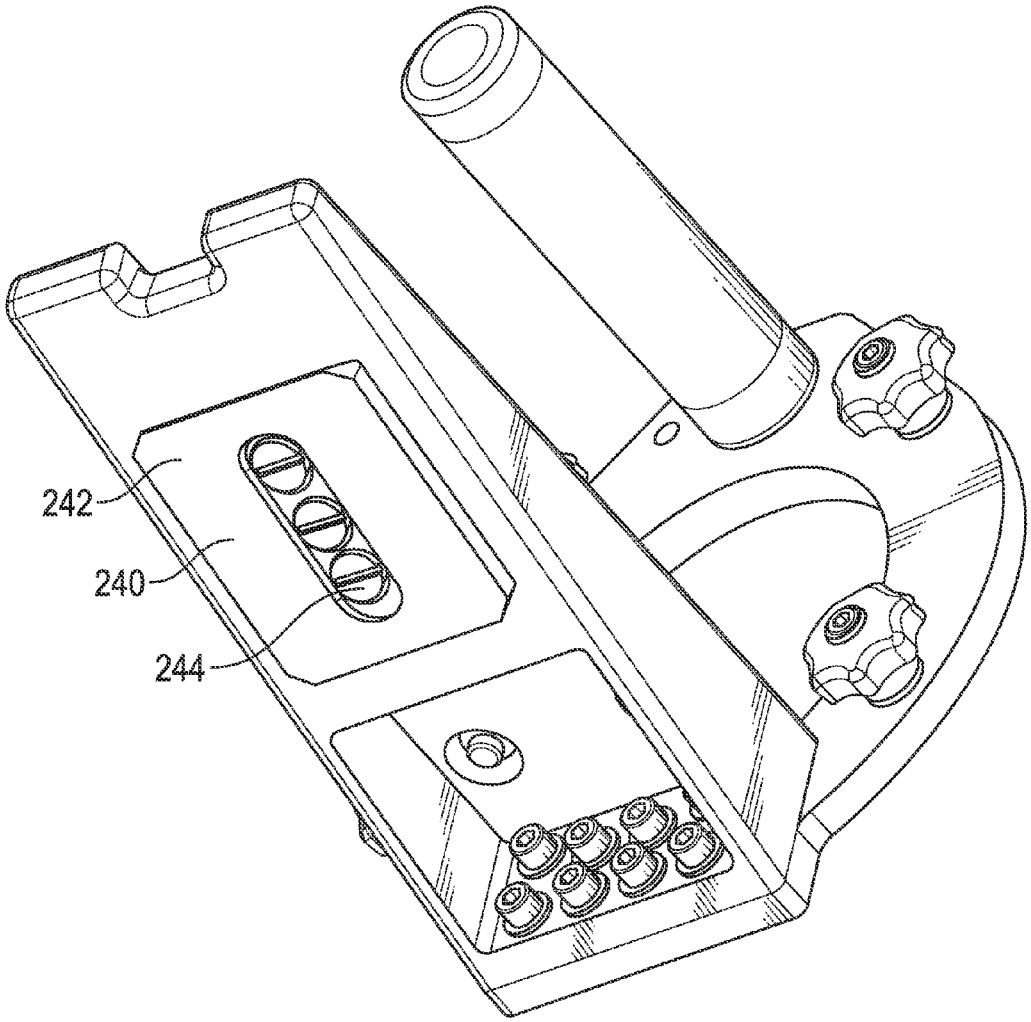
FIG. 3B illustrates a bottom perspective view of a satellite antenna adapter including a camera tripod plate installed on the satellite antenna adapter.

FIG. 3B illustrates a bottom perspective view of a satellite antenna adapter 300 including a tripod plate 240 installed on the satellite antenna adapter 300. In one embodiment, the satellite antenna adapter 300 is constructed to accept a tripod plate 240. The tripod plate 240 can mount to the mounting portion 450 of the bottom plate 400 on the bottom surface 440 of the bottom plate 400 via at least one tripod plate 240 fastener which couples to a mounting hole 451, 452, 453 in the bottom plate 400. In another embodiment, the tripod plate 240 may be built into the bottom plate 400. In another embodiment, the tripod plate 240 may be coupled to the satellite antenna adapter 300 in another fashion which may include, for example, welding, adhesives, an alternative fastener arrangement, etc.

Figure 4:
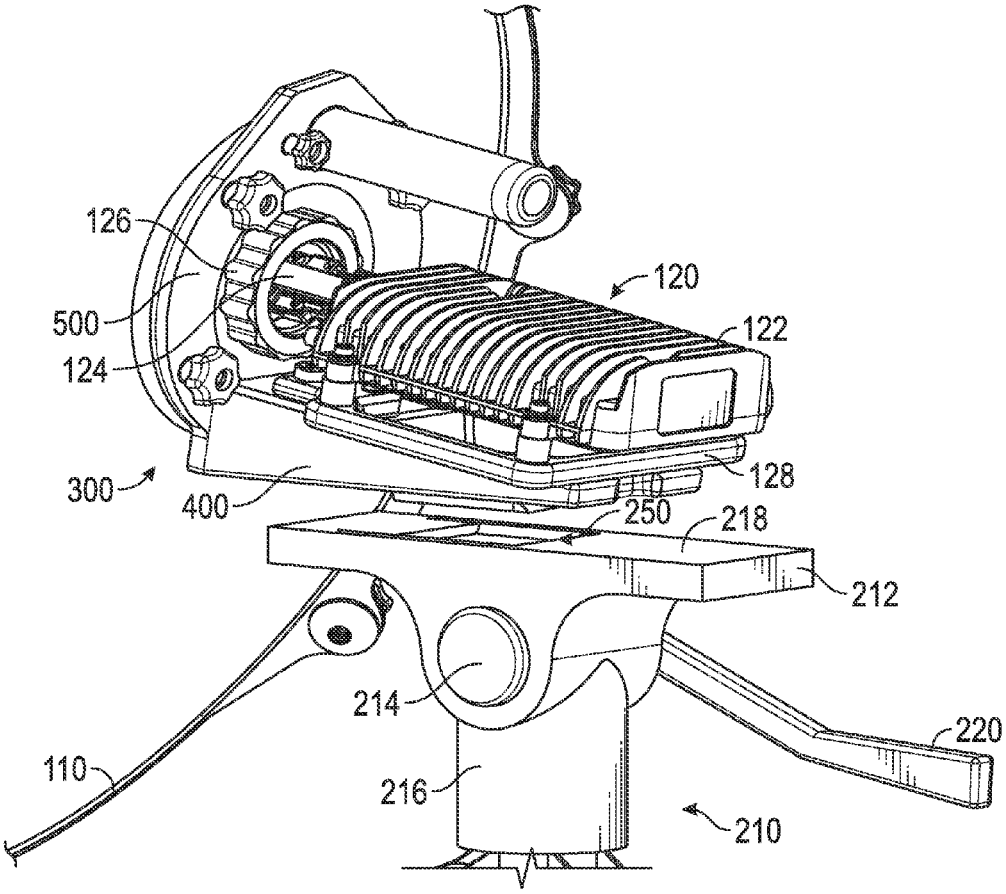
FIG. 4 illustrates a perspective view of a satellite antenna mounted to a satellite antenna adapter including a camera tripod plate and a tripod ready to receive the satellite adapter.

FIG. 4 illustrates a perspective view of a satellite antenna 100 mounted to a satellite antenna adapter 300 including a tripod plate 240 and a tripod 200 ready to receive the satellite adapter. In one embodiment, the satellite antenna adapter 300 can be constructed to rigidly couple to the satellite reflector 110 as well as to a satellite antenna feed 120.

The antenna feed 120 refers to the component of the antenna which transmits and receives signal from a satellite. The antenna feed 120 generally includes a projection 124 (as denoted in FIG. 4) travelling out from behind the reflector 110 through the aperture 550 and through an opening in the center of the reflector 110 (if included) towards the focus point of the satellite reflector 110 and may include a tip portion (not shown) located at the focus point of the satellite reflector 110 when assembled. The antenna feed 120 preferably includes a stiff linear structure for the most efficient transfer of the signal from the tip of the antenna feed 120 to the electronics that can be, for example, attached to or integrated within the antenna feed 120. Some antenna feeds 120 incorporate integrated electronics 122. In some aspects, by having a rigid and secure relationship between the antenna feed 120 and the integrated electronics 122, high quality signals can be retained at minimum cost. Often the electronics 122 will be surrounded by a casing with rib like projections which act as a heat sink, keeping the electronics 122 within their operable temperature range. In some cases, the antenna feed 120 with integrated electronics 122 can incorporate a base plate 128 configured to couple to a support platform. In some cases, for example, the apparatus illustrated in FIG. 1, the antenna feed 120 may be perpendicular to the satellite reflector 110 to ensure accurate transmission of the signal.

In one embodiment, the satellite adapter 300 may be constructed to quickly couple or uncouple from the satellite antenna feed 120 so that the assembly can be deployed quickly, for example, in the field. In some cases, the antenna feed 120 base plate 128 includes or incorporates at least one recess formed therein constructed to receive a protrusion on a satellite antenna support platform.

Many tripod receivers 212 incorporate a quick release design to allow for fast and secure mounting of equipment such as a camera to the tripod 200. The receiver 212 may be constructed to couple indirectly to a camera via a tripod plate 240 (See FIG. 3B illustrating a tripod plate 240 mounted to the satellite antenna adapter 300). The tripod plate 240 may be fastened to the camera and constructed to remain on the camera, even when the camera is not mounted to the tripod 200. The tripod plate 240 may couple to the camera via at least one tripod plate fastener 244 which passes through a hole in the tripod plate 240 and threads into an internally threaded hole located in the underside of the camera. The shape and construction of the tripod plate 240 may complement the design of the quick release capture mechanism, or the camera tripod plate receiver portion 250, of the tripod receiver 212. The tripod plate 240 may be of any desired shape, for example, rectangular or square. One or more sides of the tripod plate 240 may include an angle, bevel, or taper. The bottom or sides of the tripod plate 240 may include one or more channels or protrusions.

The tripod receiver 212 may include a tripod plate receiver portion 250 (See FIG. 4) constructed to receive a tripod plate 240 mounted to a camera or other object. The tripod plate receiver portion 250 may be constructed or configured to receive the tripod plate 240 from above or the tripod plate receiver portion 250 may be constructed to receive the tripod plate 240 from the left side, the right side, the front, or the rear of the tripod receiver 212. The tripod plate receiver portion 250 may be constructed to complement the design of the tripod plate 240. The tripod plate receiver portion 250 may incorporate a recess in the receiver 212. The recess may be rectangular in shape, for example. One or more sides of the recess may be angled, include a bevel, or a taper. The bottom or sides of the recess may include one or more protrusions. The tripod plate receiver portion 250 may incorporate a movable portion constructed to lock the tripod plate 240 in place. The tripod plate receiver portion 250 may incorporate a set screw constructed to tighten against one of the sides of the tripod plate 240. One or more sides of the recess of the tripod plate receiver portion 250 may be constructed to move relative to another side, allowing the tripod plate receiver portion 250 to clamp the tripod plate 240 in place. The tripod plate 240 and tripod plate receiver portion 250 of the receiver 212 may incorporate other means for coupling to one another which may include, for example, magnets, camlock fasteners, clips, etc.

In one embodiment, as discussed above, the satellite adapter incorporates mounting pegs 412 to couple with the antenna base plate 128. The lower portions of the mounting pegs 412 are constructed to complement the width of the recess in the base plate 128 and the upper portion is constructed to be wider than the width of the recess. In addition, the height of the lower portion is constructed to complement the thickness of the base plate 128, so that the upper portion of the mounting peg 412*s* restrain the base plate 128 to the satellite antenna adapter 300 once the recesses receive the mounting pegs 412. In one embodiment, the satellite antenna adapter 300 is constructed to locate the antenna feed 120 such that the center of gravity of the satellite antenna 100 is kept as close to the center of the tripod 200 as possible, improving stability and lowering the chance of the tripod 200 falling over in windy or unstable conditions.

In some cases, the antenna feed 120 includes a means for coupling to the satellite reflector 110. In one case, the satellite reflector 110 incorporates an annular ring-like protrusion extending back from the satellite reflector 110. In some cases, this annular protrusion includes external threading. In one embodiment, the antenna feed 120 incorporates a means for engaging the external threading, and securing the antenna feed 120 to the satellite reflector 110. In one embodiment, as illustrated in FIG. 4, the antenna feed 120 incorporates a retaining screw 126 coupled to the antenna feed 120, yet free to rotate relative to the antenna feed 120. In one embodiment, to install the antenna feed 120 onto a satellite antenna adapter 300 and satellite reflector 110, a user may place the antenna feed 120 on the top surface 410 of the bottom plate 400 rearward of its intended position, slide the antenna feed 120 towards the satellite reflector 110 ensuring that the mounting pegs 412 are received within the recesses in the antenna feed 120 base plate 128, engage the retaining screw 126 with the external threads of the annular protrusion, and tighten the retaining screw 126 down, pulling the antenna feed 120 forward and locking it in place both relative to the satellite antenna adapter 300 as well as the satellite reflector 110. In other embodiments, the satellite antenna adapter 300 may include alternative means of securing the antenna feed 120 to the satellite antenna adapter 300 which may include, for example, a clamping system, fasteners, complementing projections and recesses, etc. In some embodiments, the satellite antenna adapter 300 is constructed so that the antenna feed 120 can be quickly and easily installed and removed from the satellite antenna adapter 300 so that the satellite antenna 100 can be deployed and collapsed in the field.

Figure 5A:
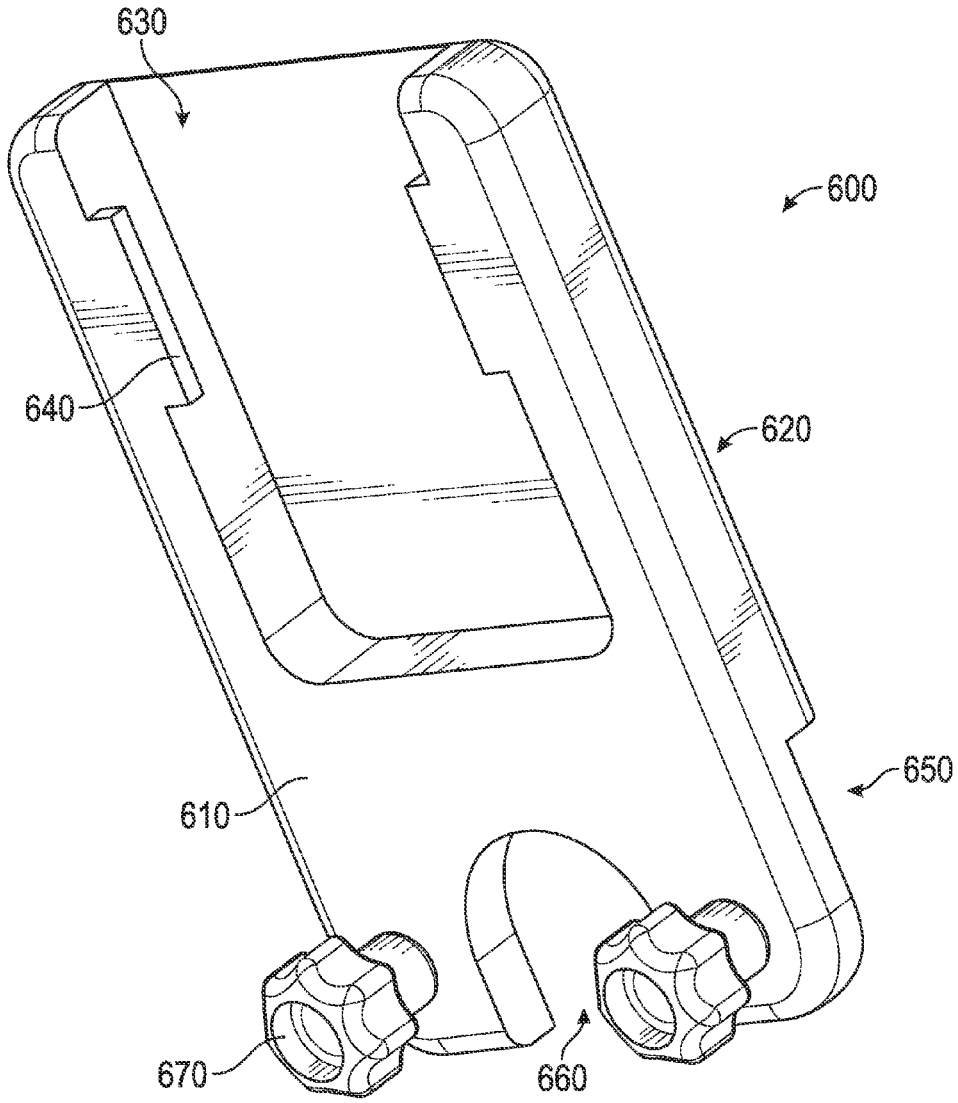
FIG. 5A illustrates a perspective view of an electronic pointing aid mount.
Figure 5B:
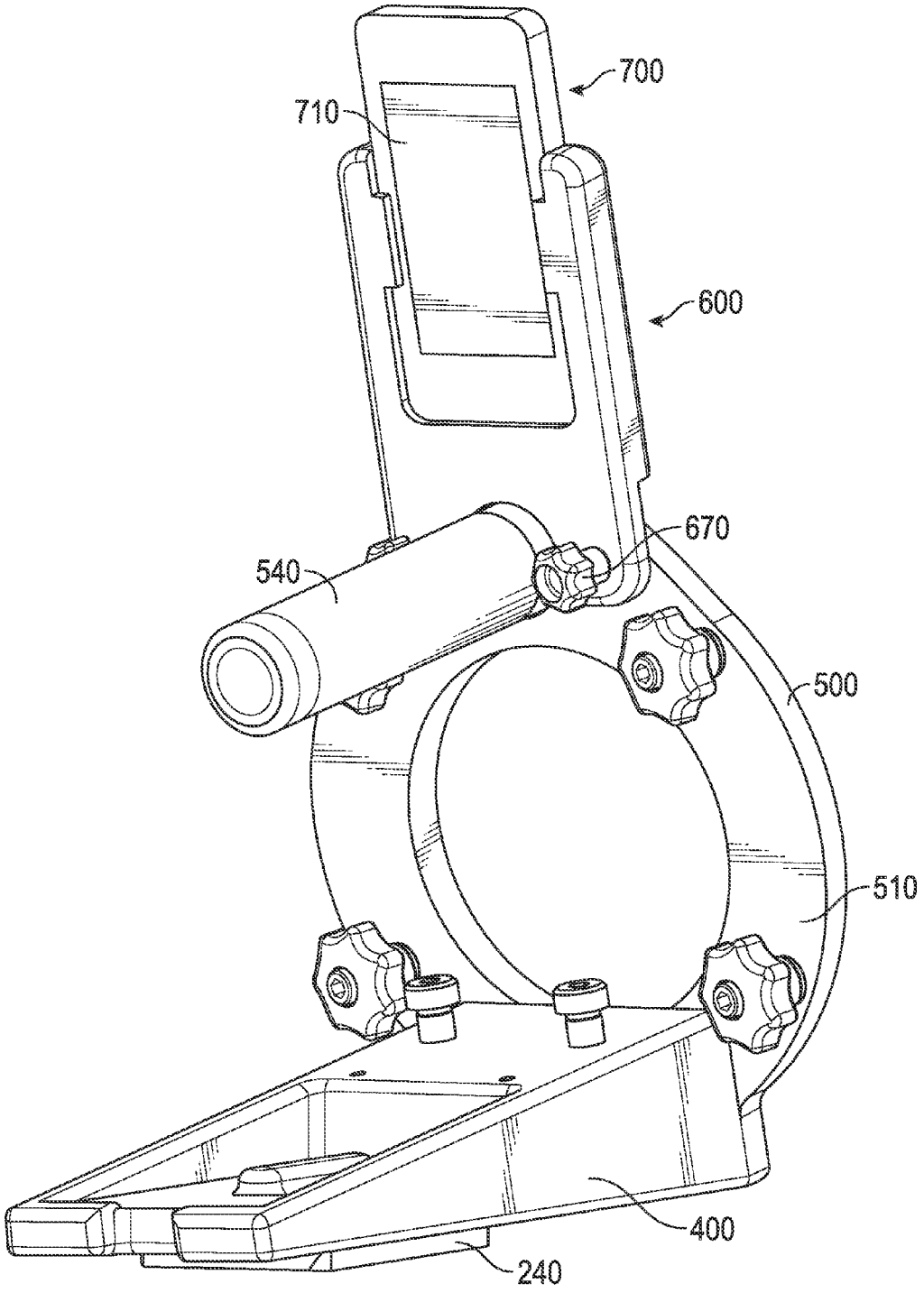
FIG. 5B illustrates a top perspective view of a satellite antenna adapter including an electronic pointing aid mount containing an electronic pointing aid installed on the satellite antenna adapter.

FIG. 5A illustrates a perspective view of an electronic pointing aid mount 600. FIG. 5B illustrates a top perspective view of a satellite antenna adapter 300 including an electronic pointing aid mount 600 with an electronic pointing aid 700 installed on the satellite antenna adapter 300. A satellite antenna 100 must be pointed at the satellite with which it is going to transmit and receive a signal. When coupled to a tripod 200 via a satellite antenna adapter 300, the tripod 200 allows the direction of the satellite antenna 100 to be adjusted for azimuth and elevation. In some cases, the polarization or skew of the satellite antenna 100 may also be adjusted. Often, an electronic pointing aid 700 may be utilized to help point the satellite antenna 100 in the proper direction. Satellite News Gathering Teams and other mobile users may prefer to reduce the amount of equipment they travel with and thus would prefer to use an existing piece of equipment for this purpose rather than carrying around an additional device. As one non-limiting example, some smart phones, when loaded with the appropriate application or software, can be capable of providing guidance during the aiming of a satellite antenna 100 towards a satellite.

In one embodiment, the satellite antenna adapter 300 may incorporate an electronic pointing aid mount 600 constructed or configured to hold an electronic pointing aid which may comprise, for example, a smartphone or other suitable device. In one embodiment, the electronic pointing aid mount 600 is constructed to hold the electronic pointing aid 700 substantially parallel to satellite reflector 110, and optionally, substantially perpendicular to the antenna feed 120, so that the viewing area 710 is facing away from the satellite reflector 110 and is in plain view of a user manipulating the satellite antenna 100. In one embodiment, the electronic pointing aid mount 600 includes a reflector facing surface 620 adjacent the reflector and a user facing surface 610 opposite the reflector facing surface 620. In one embodiment, the electronic pointing aid mount 600 includes a first recess 630 formed therein the electronic pointing aid mount 600 and passing through the user facing surface 610 so that the electronic pointing aid 700 can be seen by a user. In one embodiment, the first recess 630 may be configured so that an electronic pointing aid 700 can be installed and removed from the electronic pointing aid mount 600. In one embodiment, the electronic pointing aid mount 600 includes at least one retaining tab 640 to retain the electronic pointing aid 700 in the electronic pointing aid mount 600 without obstructing the viewing area 710 of the electronic pointing aid 700. In one embodiment, the retaining tabs 640 may be substantially stiff and in another embodiment, the retaining tabs 640 may be constructed to deflect upon installation and removal of the electronic pointing aid 700. In one embodiment, the electronic pointing aid mount 600 may incorporate alternative means for receiving and retaining an electronic pointing aid 700 which may include, for example, magnets, deflecting capturing tabs, etc.

In one embodiment the electronic pointing aid mount 600 includes a second recess 650 formed in the electronic pointing aid mount 600 and passing through the reflector facing surface 620. The second recess 650 can be configured, constructed, shaped, etc., to facilitate attachment to or acceptance of the reflector mounting plate 500. In one embodiment, the electronic pointing aid mount 600 can include a third recess 660 shaped to fit around, accommodate, compliment and/or receive the adapter handle 540. In one embodiment, the electronic pointing aid mount 600 includes at least one hole formed therethrough to allow an electronic pointing aid fastener 670 to pass through and couple the electronic pointing aid mount 600 to the reflector mounting plate 500. In one embodiment, each fastener may include, for example, a threaded portion and an engaging portion. In one embodiment, the engaging portion is constructed to allow the electronic pointing aid fastener 670 to be installed by hand. In one embodiment, the electronic pointing aid fasteners 670 are constructed to be retained by the electronic pointing aid mount 600 so the electronic pointing aid fasteners 670 are not lost after decoupling the electronic pointing aid mount 600 from the reflector mounting plate 500. In one embodiment the reflector mounting plate 500 incorporates at least one electronic pointing aid mounting hole 560 formed therethrough to accept each an electronic pointing aid fastener 670. In one embodiment, each electronic pointing aid mounting hole 560 may be internally threaded to accept the threaded portion of each an electronic pointing aid fastener 670. In other embodiments, the electronic pointing aid fastener 670 may couple to the satellite reflector 110 using alternative means, for example the coupling may be achieved with camlock fasteners, clips, magnets, slots, etc.

In some embodiments, portions of the satellite antenna 100, tripod plate 240, or tripod 200 which are rigidly coupled to the satellite antenna adapter 300 may not be permanently coupled to the satellite antenna adapter 300, but may be removably coupled, for example, so that the user can quickly and easily deploy or collapse the system in the field. In some embodiments, the fasteners disclosed herein may comprise captive screws which are constructed to remain coupled to a part after disassembly to prevent the loss of the fastener. The term "removably coupled," when used herein to define the structural relationship between a first component and a second component can mean that the first component can be affixed or attached to the second component as well as removed or separated from the second component, including instances where the attachment and/or removal is done in a timely manner so that the user can quickly and easily perform the assembly or disassembly of the components in the field. "Removably coupled" also can refer to the ability of two components to be temporarily attached or joined, in contrast to items being permanently attached.

The satellite antenna adapter 300 may be made of any suitable material or combination of materials. In one embodiment, the satellite antenna adapter 300 may be constructed of aluminum. In another embodiment, the satellite antenna adapter 300 may be constructed of another material which may include, for example, metals and alloys such as for example steel, stainless steel, titanium, iron, alloy, combinations thereof, or another metal materials; polymers, carbon, ceramics and other non-metallic materials such as plastic, thermoplastic, thermoset, acrylonitrile butadiene styrene, polycarbonate acetal, acrylic, nylon, polybutylene terephthalate, polyester liquid crystal polymer, polypropylene, polycarbonate, polyimide, polythelene, carbon fiber, and the like. In one embodiment, portions of the satellite antenna adapter 300 may be cast. In one embodiment, portions of the satellite antenna adapter 300 may be machined form a block of billet material or may include machining processes completed on a cast portion. In one embodiment, portions of the satellite antenna adapter 300 may be formed in an injection molded process. In one embodiment, the material may be reinforced with glass or carbon fibers. In one embodiment, the material may include a finish treatment which may comprise, for example, heat treating. In some embodiments, at least one portion of the satellite antenna adapter 300 may comprise different materials than other portions of the satellite antenna adapter 300. In some embodiments, different portions of the satellite antenna adapter 300 may be coupled to one another using securing means which may include, for example fasteners, magnets, camlock fasteners, clips, adhesive, welding, press fits, interference fits, friction, clamps, etc. In some embodiments, at least one threaded hole described herein may incorporate a threaded insert. The threaded inserts may comprise a material harder than that which the satellite antenna adapter 300 is constructed. The threaded inserts may comprise, for example, captive nuts, externally threaded inserts, helical inserts, molded-in inserts, or press fit inserts.

The devices, systems and methods described herein further may include or be coupled with other hardware and data processing apparatuses, which can be used to implement various illustrative logics, logical blocks, modules and circuits in connection with the aspects disclosed herein. Such hardware and data processing apparatuses may be implemented or performed with a general purpose single- or multichip processor, a digital signal processor (DSP), an application specific integrated circuit (ASIC), a field programmable gate array (FPGA) or other programmable logic device, discrete gate or transistor logic, discrete hardware components, or any combination thereof designed to perform the functions described herein. A general purpose processor may be a microprocessor, or, any conventional processor, controller, microcontroller, or state machine. A processor also may be implemented as a combination of computing modules, e.g., a combination of a DSP and a microprocessor, a plurality of microprocessors, one or more microprocessors in conjunction with a DSP core, or any other such configuration. In some implementations, particular steps and methods may be performed by circuitry that is specific to a given function. In one or more aspects, the functions may be implemented in hardware, digital electronic circuitry, computer software, firmware, including the structures disclosed in this specification and their structural equivalents thereof, or in any combination thereof. As appropriate, implementations of the subject matter described in this specification also can be implemented as one or more computer programs, i.e., one or more modules of computer program instructions, encoded on a computer storage media for execution by, or to control the operation of, data processing apparatus.

Various modifications to the implementations described in this disclosure may be readily apparent to those skilled in the art, and the generic principles defined herein may be applied to other implementations without departing from the spirit or scope of this disclosure. Thus, the claims are not intended to be limited to the implementations shown herein, but are to be accorded the widest scope consistent with this disclosure, the principles and the novel features disclosed herein. The word "exemplary" is used exclusively herein to mean "serving as an example, instance, or illustration." Any implementation described herein as "exemplary" is not necessarily to be construed as preferred or advantageous over other implementations. Additionally, a person having ordinary skill in the art will readily appreciate, the terms "upper" and "lower" are sometimes used for ease of describing the figures, and indicate relative positions corresponding to the orientation of the figure on a properly oriented page, and may not reflect the proper orientation of the device as implemented.

Certain features that are described in this specification in the context of separate implementations also can be implemented in combination in a single implementation. Conversely, various features that are described in the context of a single implementation also can be implemented in multiple implementations separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. Further, the drawings may schematically depict one more example processes in the form of a flow diagram. However, other operations that are not depicted can be incorporated in the example processes that are schematically illustrated. For example, one or more additional operations can be performed before, after, simultaneously, or between any of the illustrated operations. In certain circumstances, multitasking and parallel processing may be advantageous. Moreover, the separation of various system components in the implementations described above should not be understood as requiring such separation in all implementations, and it should be understood that the described program components and systems can generally be integrated together in a single software product or packaged into multiple software products. Additionally, other implementations are within the scope of the following claims. In some cases, the actions recited in the claims can be performed in a different order and still achieve desirable results.

In describing the present technology, the following terminology may have been used: The singular forms "a," "an," and "the" include plural referents unless the context clearly dictates otherwise. Thus, for example, reference to an item includes reference to one or more items. The term "ones" refers to one, two, or more, and generally applies to the selection of some or all of a quantity. The term "plurality" refers to two or more of an item. The term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art. The term "substantially" means that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide. Numerical data may be expressed or presented herein in a range format. It is to be understood that such a range format is used merely for convenience and brevity and thus should be interpreted flexibly to include not only the numerical values explicitly recited as the limits of the range, but also interpreted to include all of the individual numerical values or sub-ranges encompassed within that range as if each numerical value and sub-range is explicitly recited. As an illustration, a numerical range of "about 1 to 5" should be interpreted to include not only the explicitly recited values of about 1 to about 5, but also include individual values and sub-ranges within the indicated range. Thus, included in this numerical range are individual values such as 2, 3 and 4 and sub-ranges such as 1-3, 2-4 and 3-5, etc. This same principle applies to ranges reciting only one numerical value (e.g., "greater than about 1") and should apply regardless of the breadth of the range or the characteristics being described. A plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. Furthermore, where the terms "and" and "or" are used in conjunction with a list of items, they are to be interpreted broadly, in that any one or more of the listed items may be used alone or in combination with other listed items. The term "alternatively" refers to selection of one of two or more alternatives, and is not intended to limit the selection to only those listed alternatives or to only one of the listed alternatives at a time, unless the context clearly indicates otherwise.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims that follow.

What is claimed is:

1. A satellite antenna adapter comprising:

a bottom plate comprising a top surface and a bottom surface; and a reflector mounting plate coupled to said bottom plate;

wherein said bottom surface of said bottom plate is configured to removably couple to a tripod;

wherein said top surface of said bottom plate is configured to removably couple to a satellite antenna feed;

wherein said reflector mounting plate is configured to removably couple to a satellite reflector;

wherein said reflector mounting plate is substantially perpendicular to said top surface of said bottom plate.

2. The satellite antenna adapter of claim 1, further comprising a mounting portion located on said bottom surface of said bottom plate.

3. The satellite antenna adapter of claim 2, wherein said mounting portion is configured to removably couple directly to a tripod.

4. The satellite antenna adapter of claim 2, wherein said mounting portion is configured to couple to a tripod plate.

5. The satellite antenna adapter of claim 4, wherein said mounting portion comprises at least one mounting hole configured to accept a tripod plate fastener.

6. The satellite antenna adapter of claim 5, wherein the top surface of said bottom plate is inclined relative to said bottom surface of said bottom plate, wherein said top surface is furthest from said bottom surface at its portion that is adjacent to said reflector mounting plate.

7. The satellite antenna adapter of claim 6, wherein said reflector mounting plate comprises an aperture formed therethrough, wherein said aperture is configured to allow at least a portion of said antenna feed to pass through said aperture.

8. The satellite antenna adapter of claim 7, wherein said reflector mounting plate comprises at least one reflector mounting hole formed therethrough, wherein said reflector mounting hole is configured to accept a reflector fastener, wherein said reflector fastener is configured to removably couple said reflector mounting plate to said satellite reflector.

9. The satellite antenna adapter of claim 7, further comprising at least one mounting peg, wherein said at least one mounting peg protrudes from said top surface of said bottom plate, and wherein said at least one mounting peg is configured to removably couple said satellite antenna feed to said satellite antenna adapter.

10. The satellite antenna adapter of claim 9, wherein said at least one mounting peg is cylindrical in shape, wherein at least one mounting peg comprises a lower portion and an upper portion, wherein said lower portion comprises a smaller diameter than said upper portion.

11. The satellite antenna adapter of claim 7, further comprising an adapter handle, wherein said adapter handle protrudes from said reflector mounting plate.

12. The satellite antenna adapter of claim 7, wherein said antenna adapter further comprises an electronic pointing aid mount.

13. The satellite antenna adapter of claim 12, wherein said electronic pointing aid mount comprises a recess configured to accept an electronic pointing aid.

14. A satellite antenna system comprising:

the satellite antenna adapter of claim 5;

a satellite reflector; and a satellite antenna feed.

15. The satellite antenna system of claim 14, further comprising a tripod.

16. The satellite antenna system of claim 14, wherein said tripod is configured to support a camera.

17. A method of mounting a satellite antenna to a tripod comprising:

providing the satellite antenna adapter of claim 2;

coupling the satellite antenna to the satellite antenna adapter; and coupling the satellite antenna adapter to a tripod.

18. The method of claim 17, wherein coupling the satellite antenna adapter to a tripod comprises inserting a tripod plate installed on the satellite antenna adapter into a tripod plate receiver portion of a tripod.

19. The method of claim 17, wherein coupling the satellite antenna to the satellite antenna adapter comprises installing at least one reflector fastener into the satellite antenna.

20. The method of claim 17, further comprising:

decoupling the satellite antenna adapter from the tripod; and coupling a camera to the tripod.

21. A satellite antenna adapter comprising:

means for removably coupling the antenna adapter to a satellite reflector;

means for removably coupling the antenna adapter to a satellite antenna feed; and means for removably coupling the antenna adapter to a tripod comprising a tripod plate installed on the satellite antenna adapter that is configured to be inserted into a tripod plate receiver portion on the tripod.

22. The satellite antenna adapter of claim 21, wherein the means for coupling the satellite antenna to the satellite antenna adapter comprises at least one reflector fastener.

23. The satellite antenna adapter of claim 21, further comprising means for coupling the satellite antenna adapter to a Sachtler™ Touch and Go Plate.

* * * * *